US009470229B2

(12) United States Patent
Hossain et al.

(10) Patent No.: US 9,470,229 B2
(45) Date of Patent: Oct. 18, 2016

(54) SINGLE SCREW COMPRESSOR

(75) Inventors: Mohammod Anwar Hossain, Sakai (JP); Masanori Masuda, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 742 days.

(21) Appl. No.: 13/258,062

(22) PCT Filed: Mar. 19, 2010

(86) PCT No.: PCT/JP2010/002003

§ 371 (c)(1),
(2), (4) Date: Sep. 21, 2011

(87) PCT Pub. No.: WO2010/109839

PCT Pub. Date: Sep. 30, 2010

(65) Prior Publication Data

US 2012/0009079 A1 Jan. 12, 2012

(30) Foreign Application Priority Data

Mar. 24, 2009 (JP) ..... 2009-072690

(51) Int. Cl.
*F04C 18/52* (2006.01)
*F04C 18/08* (2006.01)
*F04C 29/12* (2006.01)

(52) U.S. Cl.
CPC ..... *F04C 18/52* (2013.01); *F04C 18/086* (2013.01); *F04C 29/12* (2013.01)

(58) Field of Classification Search
CPC ..... F04C 18/52; F04C 18/56; F04C 2250/10
USPC ..... 417/410.4; 418/195, 201.1, 201.3
See application file for complete search history.

(56) References Cited

U.S. PATENT DOCUMENTS

| | | | | |
|---|---|---|---|---|
| 5,082,431 | A * | 1/1992 | Bein | 418/97 |
| 5,782,624 | A * | 7/1998 | Jensen | 418/195 |
| 6,398,532 | B1 * | 6/2002 | Zha et al. | 418/195 |
| 7,153,112 | B2 * | 12/2006 | Zarnoch et al. | 418/195 |
| 7,891,955 | B2 * | 2/2011 | Picouet | 417/213 |
| 2004/0037730 | A1 * | 2/2004 | Ueno et al. | 418/195 |
| 2005/0123429 | A1 * | 6/2005 | Zarnoch et al. | 418/195 |
| 2005/0188708 | A1 * | 9/2005 | Wills et al. | 62/175 |

FOREIGN PATENT DOCUMENTS

| | | |
|---|---|---|
| JP | 06-42474 A | 2/1994 |
| JP | 2009-19623 A | 1/2009 |

OTHER PUBLICATIONS

International Search Report of corresponding PCT Application No. PCT/JP2010/002003.

* cited by examiner

*Primary Examiner* — Patrick Hamo
(74) *Attorney, Agent, or Firm* — Global IP Counselors

(57) ABSTRACT

In a single screw compressor, gates of a gate rotor mesh with helical grooves of the screw rotor in a casing. The casing has a low pressure space, and a divider wall covering the outer peripheral surface of the screw rotor to divide the fluid chamber formed by the helical groove from the low pressure space. An inlet is formed in the divider wall to partially expose the outer peripheral surface of the screw rotor to the low pressure space. The fluid chamber in a suction phase into which the low pressure fluid flows from the low pressure space is divided from the low pressure space by the gate entering the helical groove after the helical groove has moved from a position where the helical groove faces the inlet to a position where the helical groove is covered with the divider wall.

8 Claims, 9 Drawing Sheets

SINGLE SCREW COMPRESSOR

CROSS-REFERENCE TO RELATED APPLICATIONS

This U.S. National stage application claims priority under 35 U.S.C. §119(a) to Japanese Patent Application No. 2009-072690, filed in Japan on Mar. 24, 2009, the entire contents of which are hereby incorporated herein by reference.

TECHNICAL FIELD

The present invention relates to measures to improve efficiency of single screw compressors.

BACKGROUND ART

Single screw compressors have been used as compressors for compressing a refrigerant or air. For example, Japanese Patent Publication No. H06-042474 discloses a single screw compressor including a screw rotor, and two gate rotors.

The single screw compressor will be described below. The screw rotor is substantially in the shape of a column, and a plurality of helical grooves are formed in an outer peripheral surface thereof. Each of the helical grooves is opened in the outer peripheral surface of the screw rotor. Start ends of the helical grooves are opened at one of end faces of the screw rotor. Each of the gate rotors is substantially in the shape of a flat plate, and is arranged laterally adjacent to the screw rotor. The gate rotor includes a plurality of rectangular plate-shaped gates which are radially arranged. The gate rotor is arranged with an axis of rotation thereof perpendicular to an axis of rotation of the screw rotor, and the gates mesh with the helical grooves of the screw rotor.

The screw rotor and the gate rotors of the single screw compressor are contained in a casing. In the casing, low pressure space into which uncompressed, low pressure fluid flows is formed. When the screw rotor is rotated by an electric motor etc., the gate rotors are rotated by the rotation of the screw rotor. Thus, the gates of the gate rotors move relatively from the start ends (ends through which the fluid is sucked) to terminal ends (ends through which the fluid is discharged) of the helical grooves.

In a suction phase during which the low pressure fluid is sucked into fluid chambers formed by the helical grooves of the screw rotor, the low pressure fluid flows into the fluid chambers through the outer peripheral surface and the end face of the screw rotor. Then, each of the fluid chambers is divided from the low pressure space by a divider wall (an inner cylindrical wall) of the casing which covers the outer peripheral surface of the screw rotor, and the gate which enters the helical groove. In a compression phase during which the fluid in the fluid chamber is compressed, the gate moves relatively from the start end to the terminal end of the helical groove, thereby reducing a volume of the fluid chamber. Thus, the fluid in the fluid chamber is compressed.

SUMMARY

Technical Problem

In the single screw compressor described above, the low pressure fluid flows into the helical groove through the outer peripheral surface and the end face of the screw rotor in the suction phase, and the helical groove is divided from the low pressure space by the divider wall of the casing and the gate in the compression phase. In the conventional single screw compressor, whether or not a point of time when the helical groove is divided from the low pressure space by the divider wall of the casing is prior to a point of time when the helical groove is divided from the low pressure space by the gate is not particularly considered. In general, the helical groove is divided from the low pressure space simultaneously by the divider wall of the casing and the gate.

The screw rotor is rotated during the operation of the single screw compressor. Thus, if the point of time when the fluid chamber is divided from the low pressure space by the divider wall of the casing is delayed, centrifugal force is acted on the low pressure fluid in the fluid chamber in the suction phase, thereby increasing an amount of the low pressure fluid flowing from the fluid chamber toward the outer peripheral surface of the screw rotor. This reduces the amount of the fluid which flows into the fluid chamber for compression, thereby reducing efficiency of the single screw compressor.

In view of the foregoing, the present invention has been achieved. The present invention is intended to increase the amount of the fluid which flows into, and is compressed in the fluid chamber of the single screw compressor, thereby improving efficiency of the single screw compressor.

Solution to the Problem

A first aspect of the invention is directed to a single screw compressor including: a screw rotor (40) including a plurality of helical grooves (41) which are opened in an outer peripheral surface of the screw rotor to form fluid chambers (23); a gate rotor (50) including a plurality of radially arranged gates (51) which mesh with the helical grooves (41) of the screw rotor (40); and a casing (10) containing the screw rotor (40) and the gate rotor (50), wherein each of the gates (51) which meshes with the helical groove (41) of the screw rotor (40) relatively moves from a start end to a terminal end of the helical groove (41) when the screw rotor (40) is rotated, thereby compressing fluid in the fluid chamber (23) formed by the helical groove (41). Low pressure space (S1) into which uncompressed, low pressure fluid sucked into the casing (10) flows, and which communicates with the start end of the helical groove (41) opened in an end face of the screw rotor (40), and a divider wall (30) which covers the outer peripheral surface of the screw rotor (40) to divide the fluid chamber (23) formed by the helical groove (41) from the low pressure space (S1) are provided in the casing (10), an inlet (36) is formed in the divider wall (30) to partially expose the outer peripheral surface of the screw rotor (40) to the low pressure space (S1), and the fluid chamber (23) in a suction phase into which the low pressure fluid flows from the low pressure space (S1) is divided from the low pressure space (S1) by the gate (51) which enters the helical groove (41) after the helical groove (41) constituting the fluid chamber (23) has moved from a position where the helical groove faces the inlet (36) to a position where the helical groove is covered with the divider wall (30).

In the first aspect of the invention, the screw rotor (40) and the gate rotor (50) are contained in the casing (10). The low pressure space (S1) is formed in the casing (10). The low pressure space (S1) communicates with the start ends of the helical grooves (41) which are opened in the end face of the screw rotor (40). The low pressure fluid in the low pressure space (S1) flows into the helical groove (41) in the suction phase through the end face of the screw rotor (40) (i.e., through the start end of the helical groove (41)). The inlet (36) is formed in divider wall (30). When the helical groove (41) constituting the fluid chamber (23) in the suction phase is positioned to face the inlet (36), the low pressure fluid flows into the fluid chamber (23) in the suction phase through the end face of the screw rotor (40), and through the outer peripheral surface of the screw rotor (40).

In the first aspect of the invention, the helical grooves (41) formed in the screw rotor (40) move when the screw rotor (40) is rotated. The helical groove (41) constituting the fluid chamber (23) in the suction phase moves from the position where the helical groove faces the inlet (36) to the position where the helical groove is covered with the divider wall (30). For some time after the helical groove (41) has been covered with the divider wall (30), the low pressure fluid keeps flowing into the fluid chamber (23) in the suction phase through the start end of the helical groove (41) constituting the fluid chamber. Then, the fluid chamber (23) in the suction phase is divided from the low pressure space (S1) by the divider wall (30) covering the helical groove (41) constituting the fluid chamber, and the gate (51) which enters the helical groove (41) constituting the fluid chamber. When the gate (51) moves as the screw rotor (40) is further rotated, volume of the fluid chamber (23) divided from the low pressure space (S1) is reduced, thereby compressing the fluid in the fluid chamber (23).

According to a second aspect of the invention related to the first aspect of the invention, part of the outer peripheral surface of the screw rotor (40) sandwiched between two adjacent helical grooves (41) constitutes a circumferential sealing face (45) which slides on an inner side surface (35) of the divider wall (30) to seal between the two helical grooves (41), an edge of the circumferential sealing face (45) positioned forward in a direction of rotation of the screw rotor (40) constitutes a front edge (46) of the circumferential sealing face (45), and an inlet edge (37) of the inner side surface (35) of the divider wall (30) facing the inlet (36) is parallel to the front edge (46) of the circumferential sealing face (45).

In the second aspect of the invention, the circumferential sealing face (45) moves from a position where the circumferential sealing face faces the inlet (36) toward the divider wall (30) when the screw rotor (40) is rotated. In this state, the low pressure fluid flows through the outer peripheral surface of the screw rotor (40) into the fluid chamber (23) formed by the helical groove (41) which is forward of the circumferential sealing face (45) in the direction of rotation of the screw rotor (40) (i.e., the fluid chamber closer to the front edge (46) of the circumferential sealing face (45)). When the front edge (46) of the circumferential sealing face (45) passes through the inlet edge (37) of the inner side surface (35) of the divider wall (30), the helical groove (41) forward of the front edge (46) of the circumferential sealing face (45) is covered with the divider wall (30). Thus, the fluid chamber (23) in the suction phase formed by the helical groove (41) is divided from the low pressure space (S1) by the divider wall (30).

In the second aspect of the invention, the inlet edge (37) of the inner side surface (35) of the divider wall (30) is parallel to the front edge (46) of the circumferential sealing face (45). Thus, an opening of the helical groove (41) opened in the outer peripheral surface of the screw rotor (40) facing the inlet (36) is kept opened to the low pressure space (S1) throughout the whole length from the start end to the terminal end of the helical groove (41) until the front edge (46) of the circumferential sealing face (45) coincides with the inlet edge (37) of the inner side surface (35) of the divider wall (30).

According to a third aspect of the invention related to the first or second aspect of the invention, an inlet wall surface (38) of the divider wall (30) facing the inlet (36) is inclined to face the outer peripheral surface of the screw rotor (40).

In the third aspect of the invention, the low pressure fluid flowing into the fluid chamber (23) flows through the end face of the screw rotor (40) toward the inlet (36), and then changes the direction of the flow toward an axial center of the screw rotor (40) to flow into the fluid chamber (23). In this case, part of the low pressure fluid flowing into the fluid chamber (23) is hit against the inlet wall surface (38) of the divider wall (30), and then flows into the fluid chamber (23). In the present invention, the inlet wall surface (38) of the divider wall (30) is inclined to face the outer peripheral surface of the screw rotor (40). Thus, the low pressure fluid which is hit against the inlet wall surface (38) of the divider wall (30) flows along the inclined inlet wall surface (38). Thus, the direction of the flow is smoothly changed toward the axial center of the screw rotor (40).

According to a fourth aspect of the invention related to any one of the first to third aspects of the invention, the single screw compressor further includes: an electric motor (15) for rotating the screw rotor (40); and an inverter (100) for changing a frequency of alternating current supplied to the electric motor (15), wherein rotational speed of the screw rotor (40) is changeable by changing the frequency output by the inverter (100).

In the fourth aspect of the invention, the alternating current is supplied to the electric motor (15) for rotating the screw rotor (40) through the inverter (100). When the output frequency of the inverter (100) is changed, rotational speed of the electric motor (15) is changed, and rotational speed of the screw rotor (40) rotated by the electric motor (15) is also changed. The change in rotational speed of the screw rotor (40) changes a mass flow rate of the fluid which is sucked into the single screw compressor (1) and discharged after compression. Specifically, the change in rotational speed of the screw rotor (40) changes operating capacity of the single screw compressor (1).

Advantages of the Invention

In the single screw compressor (1) of the present invention, the fluid chamber (23) in the suction phase is first covered with the divider wall (30), and is then divided from the low pressure space (S1) by the gate (51) which enters the helical groove (41). Specifically, in the present invention, the fluid chamber (23) in the suction phase is blocked from the low pressure space (S1) by the divider wall (30) which covers the helical groove (41) constituting the fluid chamber in a relatively early stage.

With the fluid chamber (23) in the suction phase covered with the divider wall (30), the divider wall (30) prevents the fluid from flowing out of the fluid chamber (23) even when centrifugal force caused by the rotation of the screw rotor (40) acts on the fluid in the fluid chamber (23). Thus, according to the present invention, the amount of the fluid which leaks from the fluid chamber (23) toward the outer peripheral surface of the screw rotor (40) due to the centrifugal force can be reduced, and the amount of the fluid sucked into the fluid chamber (23) in the suction phase can be increased. This can improve efficiency of operation of the single screw compressor (1).

In the single screw compressor (1) of the present invention, the gate (51) enters the helical groove (41) which constitutes the fluid chamber (23) in the suction phase through the start end thereof after the fluid chamber (23) is covered with the divider wall (30). As the gate (51) travels into the helical groove (41) through the start end, the low pressure fluid is pushed by the gate (51) into the fluid chamber (23) formed by the helical groove (41). In the single screw compressor (1) of the present invention, the fluid chamber (23) in the suction phase has been divided from the low pressure space (S1) by the divider wall (30) when the gate (51) pushes the low pressure fluid into the fluid chamber (23) in the suction phase. Thus, the low pressure fluid pushed into the fluid chamber (23) by the gate (51) does not leak toward the outer peripheral surface of the screw rotor (40), and remains in the fluid chamber (23). According to the present invention, the amount of the low pressure fluid which flows into the fluid chamber (23) in the suction phase can be increased by the gate (51) pushing the low pressure fluid into the fluid chamber (23). This can improve the efficiency of operation of the single screw compressor (1).

In the second aspect of the invention, the inlet edge (37) of the inner side surface (35) of the divider wall (30) is parallel to the front edge (46) of the circumferential sealing face (45). Thus, an opening of the helical groove (41) in the outer peripheral surface of the screw rotor (40) facing the inlet (36) is kept opened to the low pressure space (S1) throughout the whole length thereof from the start end to the terminal end until the front edge (46) of the circumferential sealing face (45) coincides with the inlet edge (37) of the inner side surface (35) of the divider wall (30). Therefore, according to the present invention, an area of the opening of the helical groove (41) constituting the fluid chamber (23) in the suction phase and facing the inlet (36) can be kept as large as possible until the front edge (46) of the circumferential sealing face (45) coincides with the inlet edge (37) of the inner side surface (35) of the divider wall (30). This can reduce pressure loss which is caused when the low pressure fluid flows from the low pressure space (S1) to the fluid chamber (23) in the suction phase.

In the third aspect of the invention, the inlet wall surface (38) of the divider wall (30) is inclined to face the outer peripheral surface of the screw rotor (40). Thus, the direction of the flow of the low pressure fluid which is hit against the inlet wall surface (38) of the divider wall (30) is smoothly changed toward the axial center of the screw rotor (40) by the inclined inlet wall surface (38). Therefore, according to the present invention, turbulence of the flow of the low pressure fluid to the fluid chamber (23) in the suction phase can be reduced, thereby reducing the pressure loss which is caused when the low pressure fluid flows from the low pressure space (S1) to the fluid chamber (23) in the suction phase.

In the fourth aspect of the invention, the alternating current is supplied to the electric motor (15) for driving the screw rotor (40) through the inverter (100). When the output frequency of the inverter (100) is changed, the rotational speed of the screw rotor (40) is changed, thereby changing the operating capacity of the single screw compressor (1).

In the single screw compressor (1) whose operating capacity can be changed by changing the output frequency of the inverter (100), the rotational speed of the screw rotor (40) may be set higher as compared with the case where, for example, power is directly supplied from a commercial power supply to the electric motor (15) without using the inverter (100). When the rotational speed of the screw rotor (40) increases, the centrifugal force acted on the fluid in the fluid chamber (23) in the suction phase also increases, and the amount of the fluid leaks from the fluid chamber (23) toward the outer peripheral surface of the screw rotor (40) may increase.

According to the fourth aspect of the invention, the helical groove (41) constituting the fluid chamber (23) in the suction phase is first divided from the low pressure space (S1) by the divider wall (30), and then is divided from the low pressure space (S1) by the gate (51) which enters the helical groove (41). Thus, the fluid chamber (23) in the suction phase can be divided from the low pressure space (S1) by the divider wall (30) covering the helical groove (41) constituting the fluid chamber in a relatively early stage. Therefore, in the single screw compressor (1) of the fourth aspect of the invention in which the rotational speed of the screw rotor (40) can be set high, the amount of the fluid which leaks from the fluid chamber (23) toward the outer peripheral surface of the screw rotor (40) due to the centrifugal force can be reduced. This can keep the efficiency of operation of the single screw compressor (1) high.

Travel speed of the gate (51) increases with the increase in rotational speed of the screw rotor (40). The higher the travel speed of the gate (51) is, the less fluid leaks from the fluid chamber (23) in the suction phase toward the start end of the helical groove (41) while the gate (51) travels into the helical groove (41). Specifically, the higher the rotational speed of the screw rotor (40) is, the more low pressure fluid is pushed into the fluid chamber (23) in the suction phase by the gate (51). Thus, in the single screw compressor (1) of the fourth aspect of the invention, the amount of the low pressure fluid flowing to the fluid chamber (23) in the suction phase can sufficiently be ensured even when the rotational speed of the screw rotor (40) is set high. This can keep the efficiency of operation of the single screw compressor (1) high.

BRIEF DESCRIPTION OF THE DRAWINGS

FIG. 6(A) shows a fluid chamber in a suction phase exposed to an inlet, FIG. 6(B) shows the fluid chamber in the suction phase divided from low pressure space only by a cylindrical wall, and FIG. 6(C) shows the fluid chamber in the suction phase divided from the low pressure space by both of the cylindrical wall and a gate.

FIG. 8(A) shows a suction phase, FIG. 8(B) shows a compression phase.

FIG. 9(A) shows a fluid chamber in a suction phase exposed to an inlet, FIG. 9(B) shows the fluid chamber in the suction phase divided from low pressure space only by a cylindrical wall, and FIG. 9(C) shows the fluid chamber in the suction phase divided from the low pressure space by both of the cylindrical wall and a gate.

DESCRIPTION OF EMBODIMENTS

An embodiment of the present invention will be described in detail below with reference to the drawings.

A single screw compressor (1) of the present embodiment (hereinafter merely referred to as a screw compressor) is provided in a refrigerant circuit for performing a refrigeration cycle, and compresses a refrigerant.

Figure 1:
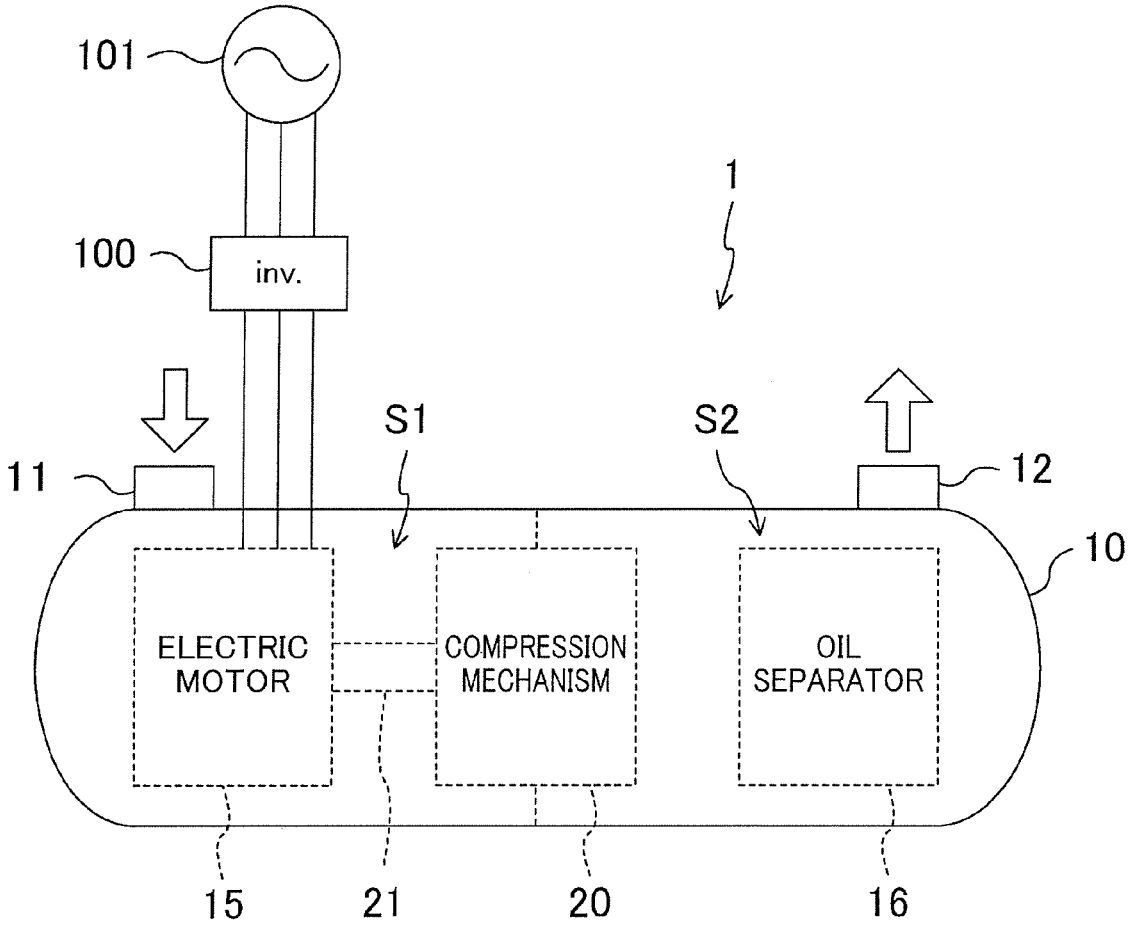
FIG. 1 is a schematic view illustrating a structure of a single screw compressor.

As shown in FIG. 1, the screw compressor (1) includes a casing (10) containing a compression mechanism (20), and an electric motor (15) for driving the compression mechanism. The screw compressor (1) is semi-hermetic.

The casing (10) is in the shape of a horizontally-oriented cylinder. Space inside the casing (10) is divided into low pressure space (S1) close to an end of the casing (10), and high pressure space (S2) close to the other end of the casing (10). An inlet (11) communicating with the low pressure space (S1), and an outlet (12) communicating with the high pressure space (S2) are formed in the casing (10). A low pressure gaseous refrigerant (i.e., low pressure fluid) flowed from an evaporator of the refrigerant circuit passes through the inlet (11) to enter the low pressure space (S1). A compressed, high pressure gaseous refrigerant discharged from the compression mechanism (20) to the high pressure space (S2) passes through the outlet (12), and is supplied to a condenser of the refrigerant circuit.

In the casing (10), the electric motor (15) is arranged in the low pressure space (S1), and the compression mechanism (20) is arranged between the low pressure space (S1) and the high pressure space (S2). A drive shaft (21) of the compression mechanism (20) is coupled to the electric motor (15). An oil separator (16) is arranged in the high pressure space (S2). The oil separator (16) separates refrigeration oil from the refrigerant discharged from the compression mechanism (20).

The screw compressor (1) includes an inverter (100). The inverter (100) is connected to a commercial power supply (101) through an input end thereof, and is connected to the electric motor (15) through an output end thereof. The inverter (100) adjusts a frequency of alternating current input from the commercial power supply (101), and supplies the alternating current of the adjusted frequency to the electric motor (15).

Figure 2:
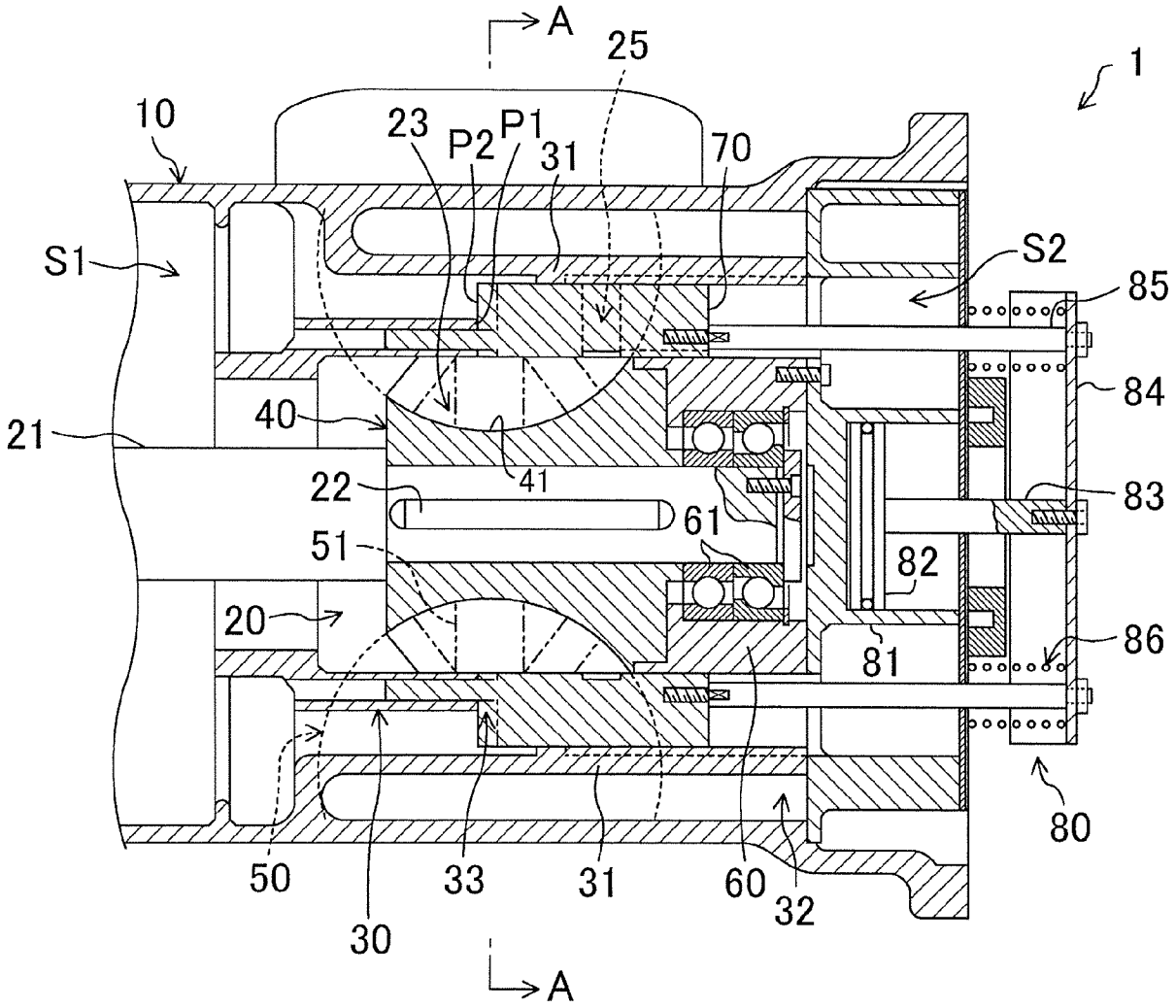
FIG. 2 is a cross-sectional view illustrating a major part of the single screw compressor.
Figure 3:
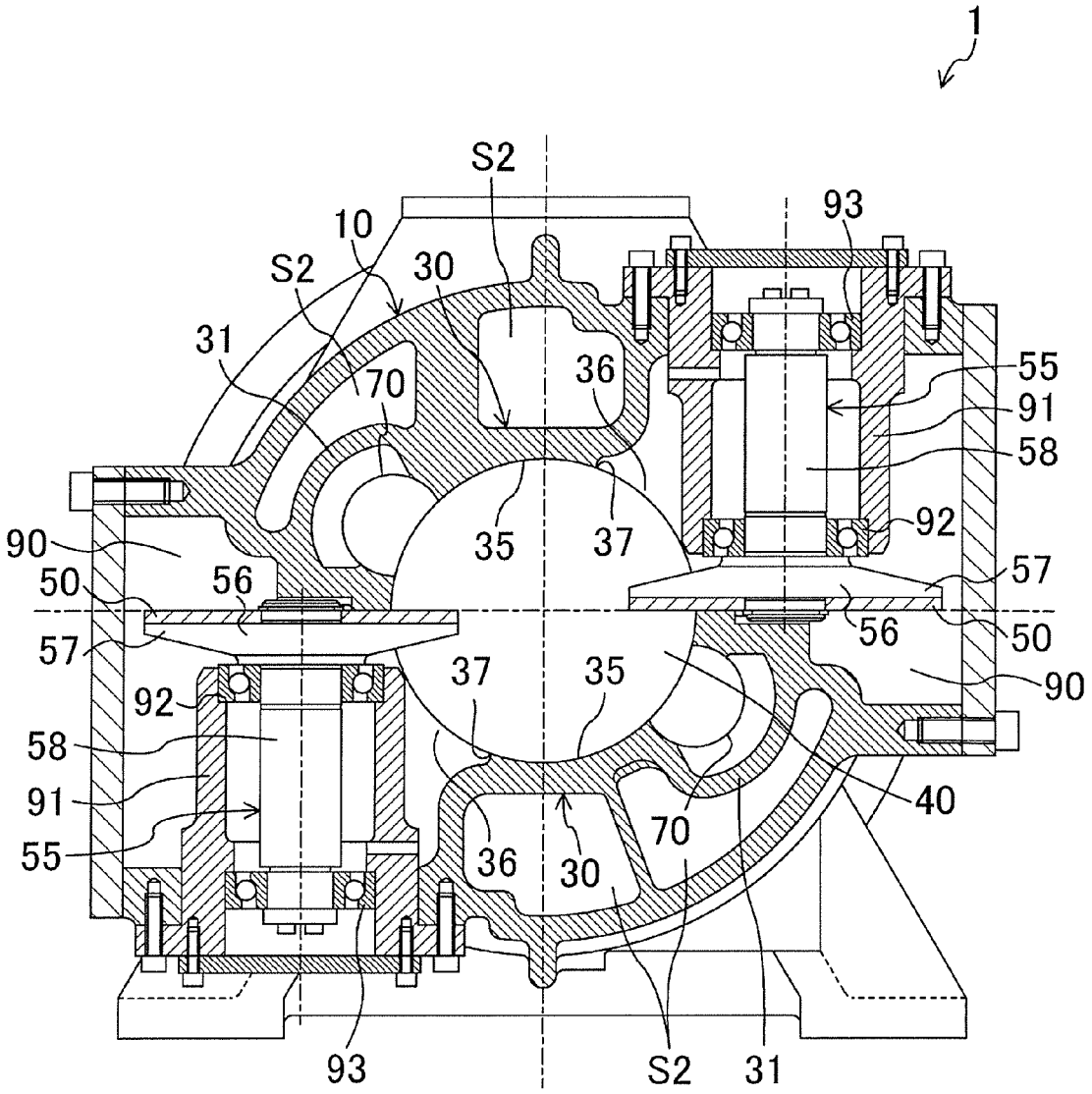
FIG. 3 is a cross-sectional view taken along the line A-A shown in FIG. 2.

As shown in FIGS. 2 and 3, the compression mechanism (20) includes a cylindrical wall (30) formed in the casing (10), a screw rotor (40) arranged in the cylindrical wall (30), and two gate rotors (50) which mesh with the screw rotor (40).

The cylindrical wall (30) is provided to cover an outer peripheral surface of the screw rotor (40). The cylindrical wall (30) constitutes a divider wall. The cylindrical wall (30) will be described in detail later.

The drive shaft (21) is inserted in the screw rotor (40). The screw rotor (40) and the drive shaft (21) are coupled through a key (22). The drive shaft (21) is arranged coaxially with the screw rotor (40). A tip end of the drive shaft (21) is rotatably supported by a bearing holder (60) provided on a high pressure side of the compression mechanism (20) (on the right side of the compression mechanism provided that an axial direction of the drive shaft (21) in FIG. 1 is a right-left direction). The bearing holder (60) supports the drive shaft (21) through ball bearings (61).

Figure 4:
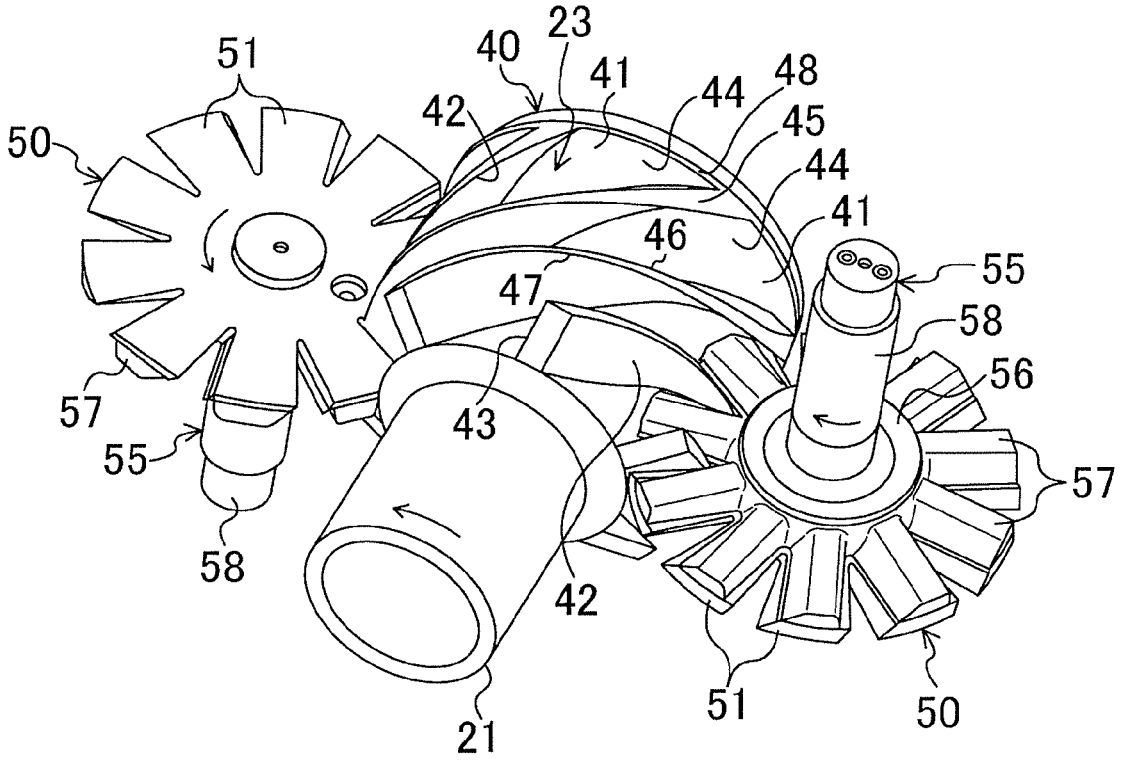
FIG. 4 is a perspective view illustrating a major part of the single screw compressor.
Figure 5:
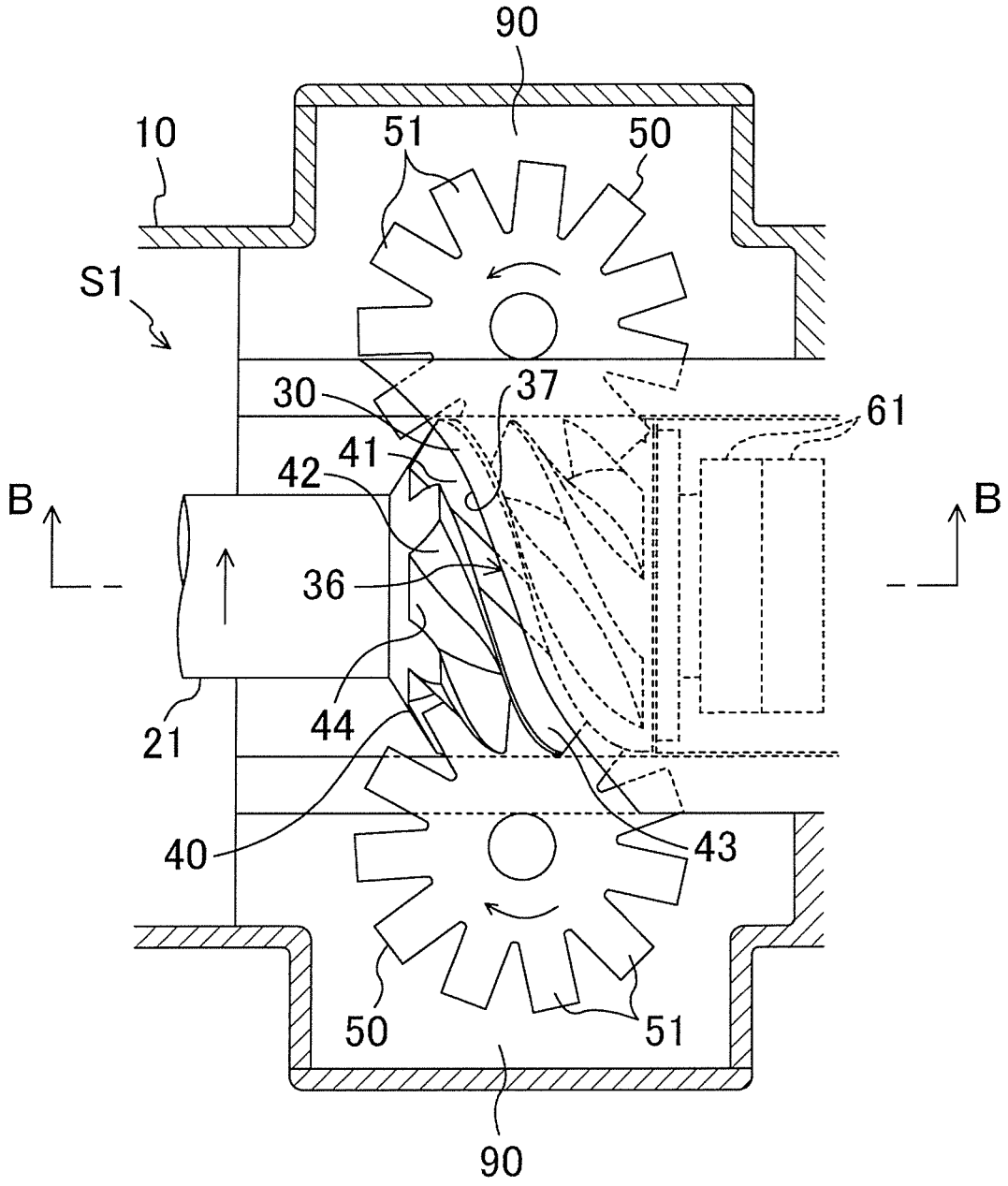
FIG. 5 is a schematic view illustrating a major part of the single screw compressor, partially in section.

The screw rotor (40) is a substantially columnar metal member as shown in FIGS. 4 and 5. The screw rotor (40) is rotatably inserted in the cylindrical wall (30). The screw rotor (40) includes a plurality of helical grooves (41) (six helical grooves in the present embodiment), each of which helically extends from an end to the other end of the screw rotor (40). Each of the helical grooves (41) is opened in the outer peripheral surface of the screw rotor (40), and constitutes a fluid chamber (23).

Each of the helical grooves (41) of the screw rotor (40) has a left end in FIG. 5 as a start end, and a right end in FIG. 5 as a terminal end. In FIG. 5, a left end face (an end face through which the refrigerant is sucked) of the screw rotor (40) is tapered. In the screw rotor (40) shown in FIG. 5, the start ends of the helical grooves (41) are opened in the tapered left end face, while the terminal ends of the helical grooves (41) are not opened in a right end face. Each of the helical grooves (41) has a front wall (42) which is a sidewall positioned forward in a direction of rotation of the screw rotor (40), and a back wall (43) which is a sidewall positioned backward in the direction of rotation of the screw rotor (40).

Part of the outer peripheral surface of the screw rotor (40) sandwiched between two adjacent helical grooves (41) constitutes a circumferential sealing face (45). An edge of the circumferential sealing face (45) positioned forward in the direction of rotation of the screw rotor (40) constitutes a front edge (46), and the other edge positioned backward in the direction of rotation of the screw rotor (40) constitutes a back edge (47). Part of the outer peripheral surface of the screw rotor (40) adjacent to the terminal ends of the helical grooves (41) constitutes an axial sealing face (48). The axial sealing face (48) is a circumferential surface extending along the end face of the screw rotor (40).

As described above, the screw rotor (40) is inserted in the cylindrical wall (30). The circumferential sealing face (45) and the axial sealing face (48) of the screw rotor (40) slide on an inner side surface (35) of the cylindrical wall (30).

The circumferential sealing face (45) and the axial sealing face (48) of the screw rotor (40) are not in physical contact with the inner side surface (35) of the cylindrical wall (30), and a minimum clearance is provided between the sealing faces and the inner side surface to allow smooth rotation of the screw rotor (40). An oil film made of the refrigeration oil is formed between the circumferential sealing face (45) and the axial sealing face (48) of the screw rotor (40), and the inner side surface (35) of the cylindrical wall (30), thereby keeping the fluid chamber (23) gastight.

Each of the gate rotors (50) is a resin member including a plurality of radially arranged, rectangular plate-shaped gates (51) (11 gates in this embodiment). Each of the gate rotors (50) is arranged outside the cylindrical wall (30) to be axially symmetric with the axis of rotation of the screw rotor (40). Specifically, in the screw compressor (1) of the present embodiment, the two gate rotors (50) are arranged at equal angular intervals about the axis of rotation of the screw rotor (40) (at 180° intervals in the present embodiment). A shaft center of each of the gate rotors (50) is perpendicular to a shaft center of the screw rotor (40). Each of the gate rotors (50) is arranged in such a manner that the gates (51) penetrate part of the cylindrical wall (30) to mesh with the helical grooves (41) of the screw rotor (40).

With the gate (51) meshed with the helical groove (41) of the screw rotor (40), side surfaces of the gate slide on the front wall (42) and the back wall (43) of the helical groove (41), respectively, and a tip end of the gate (51) slides on a bottom (44) of the helical groove (41). A minimum clearance is provided between the gate (51) meshed with the helical groove (41) and the screw rotor (40) to allow smooth rotation of the screw rotor (40). An oil film made of the refrigeration oil is formed between the gate (51) meshed with the helical groove (41) and the screw rotor (40). The oil film ensures gastightness of the fluid chamber (23).

The gate rotors (50) are attached to metal rotor supports (55), respectively (see FIGS. 3 and 4). Each of the rotor supports (55) includes a base (56), arms (57), and a shaft (58). The base (56) is in the shape of a slightly thick disc. The number of the arms (57) is the same as the number of the gates (51) of the gate rotor (50), and the arms extend radially outward from an outer peripheral surface of the base (56). The shaft (58) is in the shape of a rod, and is placed to stand on the base (56). A center axis of the shaft (58) coincides with a center axis of the base (56). The gate rotor (50) is attached to be opposite the rod (58) with respect to the base (56) and the arms (57). The arms (57) are in contact with rear surfaces of the gates (51), respectively.

Each of the rotor supports (55) to which the gate rotor (50) is attached is placed in a gate rotor chamber (90) which is provided adjacent to the cylindrical wall (30) in the casing (10) (see FIG. 3). The rotor support (55) on the right of the screw rotor (40) in FIG. 3 is arranged with the gate rotor (50) facing downward. The rotor support (55) on the left of the screw rotor (40) in FIG. 3 is arranged with the gate rotor (50) facing upward. The shaft (58) of each of the rotor supports (55) is rotatably supported by a bearing housing (91) in the gate rotor chamber (90) through ball bearings (92, 93). Each of the gate rotor chambers (90) communicates with the low pressure space (S1).

The screw compressor (1) includes a slide valve (70) as a capacity control mechanism. The slide valve (70) is placed in a slide valve container (31) which is formed with two parts of the cylindrical wall (30) expanded radially outward. The slide valve (70) has an inner surface which is flush with the inner side surface of the cylindrical wall (30), and is slidable in the axial direction of the cylindrical wall (30).

When the slide valve (70) slides closer to the high pressure space (S2) (to the right provided that the axial direction of the drive shaft (21) shown in FIG. 2 is the right-left direction), an axial clearance is formed between an end face (P1) of the slide valve container (31) and an end face (P2) of the slide valve (70). The axial clearance constitutes a bypass passage (33) through which the refrigerant returns from the fluid chamber (23) to the low pressure space (S1). When the slide valve (70) is moved to change the size of the bypass passage (33), capacity of the compression mechanism (20) is changed. The slide valve (70) is provided with a discharge port (25) through which the fluid chamber (23) and the high pressure space (S2) communicate with each other.

The screw compressor (1) includes a slide valve driving mechanism (80) for sliding the slide valve (70). The slide valve driving mechanism (80) includes a cylinder (81) fixed to the bearing holder (60), a piston (82) inserted in the cylinder (81), an arm (84) coupled to a piston rod (83) of the piston (82), a coupling rod (85) which couples the arm (84) and the slide valve (70), and a spring (86) which biases the arm (84) to the right in FIG. 2 (to the direction in which the arm (84) is separated from the casing (10)).

In the slide valve driving mechanism (80) shown in FIG. 2, inner pressure in space on the left of the piston (82) (space adjacent to the piston (82) closer the screw rotor (40)) is higher than inner pressure in space on the right of the piston (82) (space adjacent to the piston (82) closer to the arm (84)). The slide valve driving mechanism (80) is configured to adjust the position of the slide valve (70) by adjusting the inner pressure in the space on the right of the piston (82) (i.e., gas pressure in the right space).

When the screw compressor (1) is being operated, suction pressure of the compression mechanism (20) is acted on one of axial end faces of the slide valve (70), and discharge pressure of the compression mechanism (20) is acted on the other axial end face. Thus, during the operation of the screw compressor (1), the slide valve (70) always receives force which presses the slide valve (70) toward the low pressure space (S1). When the inner pressures in the spaces on the left and right of the piston (82) in the slide valve driving mechanism (80) are changed, force which pulls the slide valve (70) back to the high pressure space (S2) is changed, thereby changing the position of the slide valve (70).

Figure 6:
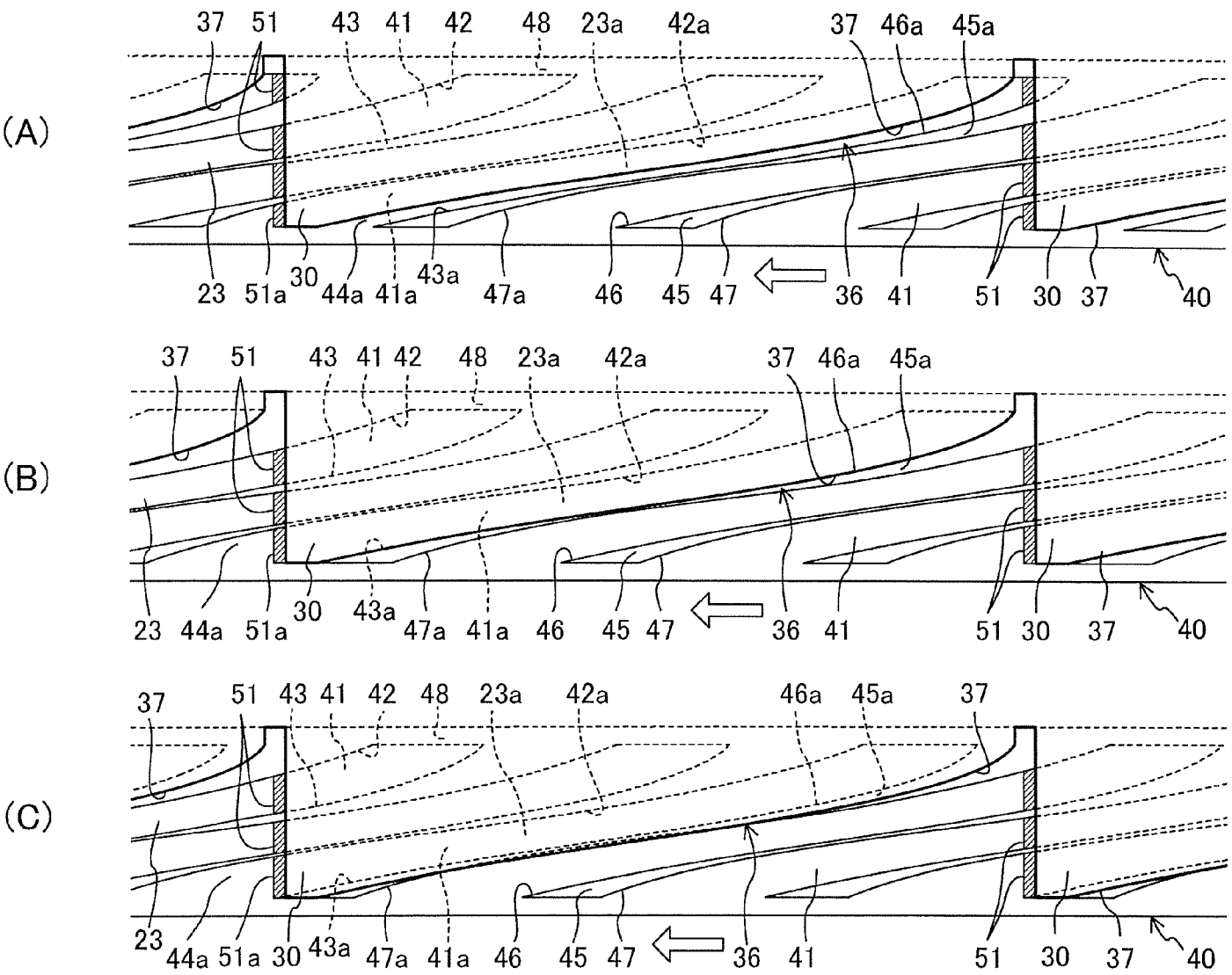
FIGS. 6(A) to 6(C) are developments of a screw rotor and a cylindrical wall.

Details of the cylindrical wall (30) will be described below with reference to FIGS. 5-7.

As shown in FIG. 5, an inlet (36) which partially exposes the outer peripheral surface of the screw rotor (40) to the low pressure space (S1) is formed in the cylindrical wall (30). A dimension of the inlet (36) in the circumferential direction of the cylindrical wall (30) is gradually reduced from the left end to the right end of the screw rotor (40) shown in FIG. 5. FIG. 5 shows the inlet (36) formed in part of the cylindrical wall (30) covering the screw rotor (40) from above. In addition, the inlet (36) is formed in part the cylindrical wall (30) covering the screw rotor (40) from below (see FIG. 3). The inlet (36) formed in the part of the cylindrical wall (30) covering the screw rotor (40) from below is axially symmetric with the inlet (36) formed in the part of the cylindrical wall (30) covering the screw rotor (40) from above relative to the axis of rotation of the screw rotor (40).

An edge of the inner side surface (35) of the cylindrical wall (30) facing the inlet (36) constitutes an inlet edge (37). As shown in FIG. 6, the inlet edge (37) of the inner side surface (35) of the cylindrical wall (30) is curved parallel to the front edge (46) of the circumferential sealing face (45) of the screw rotor (40). The inlet edge (37) is parallel to the front edge (46) of the circumferential sealing face (45) throughout the whole length thereof. Thus, the inlet edge (37) can coincide throughout the whole length thereof with the front end (46) of the circumferential sealing face (45) which moves as the screw rotor (40) is rotated (see FIG. 6(B)). The inlet edge (37) is positioned in such a manner that the gate (51*a*) which enters the helical groove (41*a*) adjacent to the front edge (46*a*) does not contact the back wall (43*a*) of the helical groove (41*a*) when the inlet edge (37) coincides with the front edge (46*a*) of the circumferential sealing face (45*a*) (see FIG. 6(B)).

Figure 7:
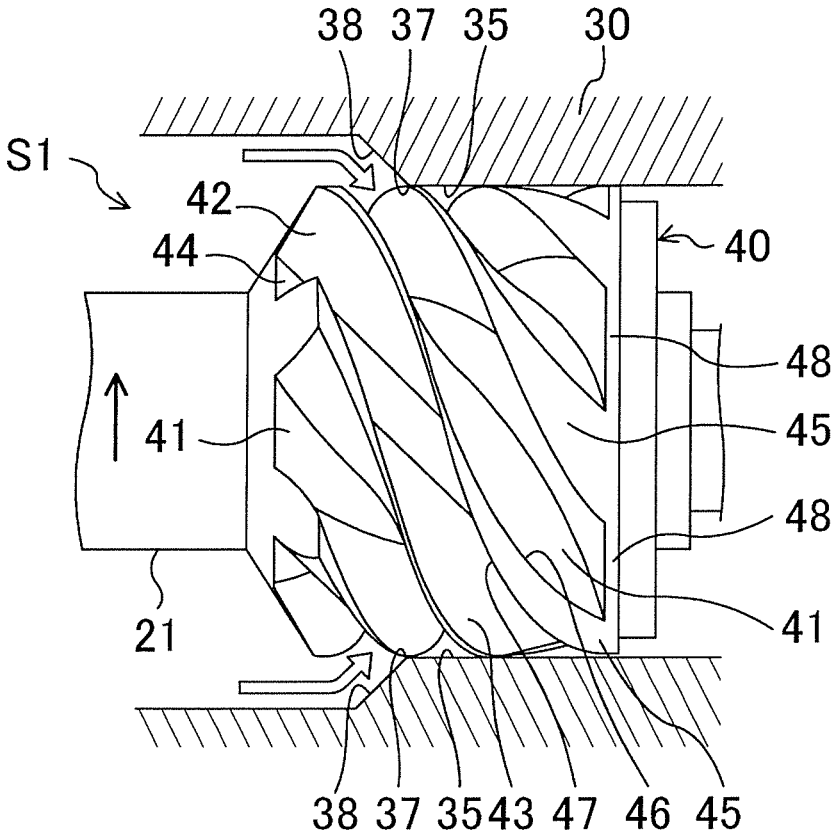
FIG. 7 is a cross-sectional view taken along the line B-B shown in FIG. 5.

As shown in FIG. 7, part of the inner side surface of the cylindrical wall (30) facing the inlet (36) (i.e., part of the inner side surface (35) of the cylindrical wall extending from the inlet edge (37) toward the outer peripheral surface of the cylindrical wall (30)) constitutes an inlet wall surface (38). The inlet wall surface (38) is inclined to face the screw rotor (40). Specifically, the inlet wall surface (38) is inclined with a right part thereof closer to the screw rotor (40) than a left part thereof as shown in FIG. 7.

Working Mechanism

A working mechanism of the screw compressor (1) will be described below.

Figure 8:
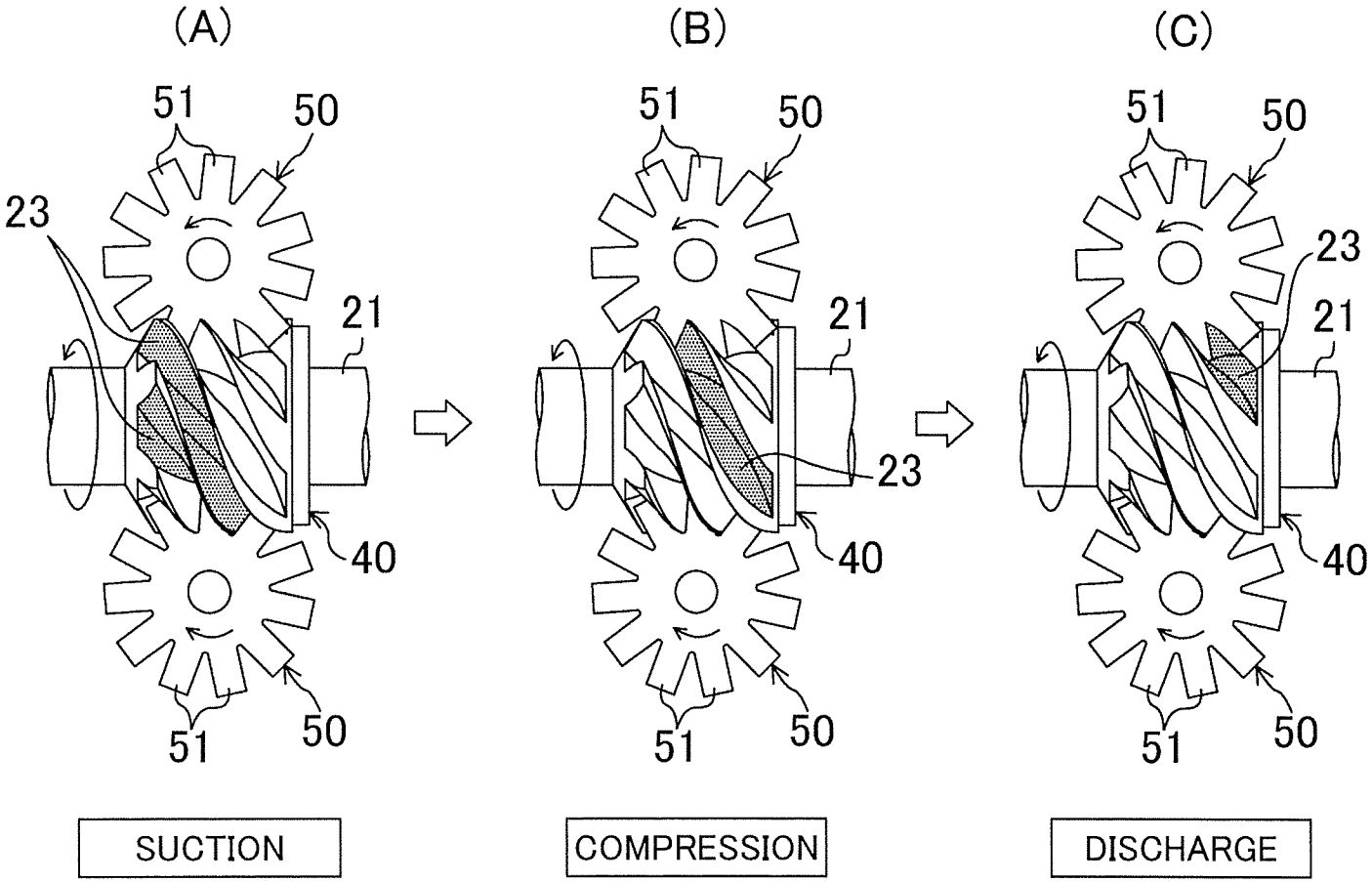
FIGS. 8(A) and 8(B) are plan views illustrating operation of a compression mechanism of a single screw compressor.
FIG. 8(C) shows a discharge phase.

When the electric motor (15) of the screw compressor (1) is driven, the drive shaft (21) is rotated to rotate the screw rotor (40). As the screw rotor (40) is rotated, the gate rotors (50) are also rotated, and a suction phase, a compression phase, and a discharge phase of the compression mechanism (20) are repeated. In the following description, the fluid chamber (23) which is shaded in FIG. 8 will be described.

In FIG. 8(A), the shaded fluid chamber (23) communicates with the low pressure space (S1). The helical groove (41) constituting the fluid chamber (23) meshes with the gate (51) of the lower gate rotor (50) shown in FIG. 8(A). When the screw rotor (40) is rotated, the gate (51) relatively moves toward the terminal end of the helical groove (41), thereby increasing volume of the fluid chamber (23). Thus, the low pressure gaseous refrigerant in the low pressure space (S1) is sucked into the fluid chamber (23).

When the screw rotor (40) is further rotated, the fluid chamber (23) is in the state shown in FIG. 8(B). As shown in FIG. 8(B), the shaded fluid chamber (23) is completely closed. Thus, the helical groove (41) constituting this fluid chamber (23) meshes with the gate (51) of the upper gate rotor (50) shown in FIG. 8(B), and is divided from the low pressure space (S1) by the gate (51). When the gate (51) relatively moves toward the terminal end of the helical groove (41) as the screw rotor (40) is rotated, the volume of the fluid chamber (23) gradually decreases. Thus, the gaseous refrigerant in the fluid chamber (23) is compressed.

When the screw rotor (40) is further rotated, the fluid chamber (23) is in the state shown in FIG. 8(C). In FIG. 8(C), the shaded fluid chamber (23) communicates with the high pressure space (S2) through the discharge port (25). When the gate (51) relatively moves toward the terminal end of the helical groove (41) as the screw rotor (40) is rotated, the compressed refrigerant gas is pushed out of the fluid chamber (23) to the high pressure space (S2).

The suction phase in which the low pressure gaseous refrigerant flows into the fluid chamber (23) will be described in detail with reference to FIGS. 6(A)-6(C). In the following description, the helical groove (41*a*) constituting the fluid chamber (23*a*) in the suction phase will be described.

In FIG. 6(A), part of the helical groove (41*a*) is covered with the cylindrical wall (30), and the remaining part faces the inlet (36). The gate (51) is about to enter the helical groove (41*a*) from the start end thereof. The gate (51*a*) slides only on the front wall (42*a*) and the bottom (44*a*) of the helical groove (41*a*), but does not slide on the back wall (43*a*) of the helical groove (41*a*).

In the state shown in FIG. 6(A), the fluid chamber (23*a*) in the suction phase formed by the helical groove (41*a*) communicates with the low pressure space (S1) through openings thereof in the outer peripheral surface and the end face of the screw rotor (40). In this state, the low pressure gaseous refrigerant flows into the fluid chamber (23*a*) through both of the openings in the outer peripheral surface and the end face of the screw rotor (40).

When the screw rotor (40) in the state of FIG. 6(A) is further rotated, the fluid chamber (23*a*) enters the state shown in FIG. 6(B). In the state of FIG. 6(B), the front edge (46*a*) of the circumferential sealing face (45*a*) adjacent to the helical groove (41*a*) coincides with the inlet edge (37) of the inner side surface (35) of the cylindrical wall (30). At the time when the fluid chamber (23*a*) enters the state shown in FIG. 6(B), the whole part of the helical groove (41*a*) constituting the fluid chamber (23*a*) in the suction phase is covered with the cylindrical wall (30). Thus, at this point of time, the opening of the fluid chamber (23*a*) in the outer peripheral surface of the screw rotor (40) is completely closed by the cylindrical wall (30). Thus, the fluid chamber (23*a*) is divided from the low pressure space (S1) by the cylindrical wall (30).

In the state shown in FIG. 6(B), like the state shown in FIG. 6(A), the gate (51*a*) which is about to enter the helical groove (41*a*) does not slide on the back wall (43*a*) of the helical groove (41*a*). Thus, the opening of the fluid chamber (23*a*) in the outer peripheral surface of the screw rotor (40) is closed by the cylindrical wall (30) to divide the fluid chamber (23*a*) in the suction phase from the low pressure space (S1), while the opening of the fluid chamber (23*a*) in the end face of the screw rotor (40) still communicates with the low pressure space (S1). In this state, the low pressure gaseous refrigerant flows into the fluid chamber (23*a*) only through the opening in the end face of the screw rotor (40).

When the screw rotor (40) in the state of FIG. 6(B) is further rotated, the fluid chamber (23*a*) is in the state shown in FIG. 6(C). In the state of FIG. 6(C), the front edge (46*a*) of the circumferential sealing face (45*a*) has passed the inlet edge (37) of the inner side surface (35) of the cylindrical wall (30). The inlet edge (37) of the inner side surface (35) of the cylindrical wall (30) is positioned between the front edge (46*a*) and the back edge (47*a*) of the circumferential sealing face (45*a*).

At a point of time when the fluid chamber has entered the state shown in FIG. 6(C), the gate (51*a*) which entered the helical groove (41*a*) starts to slide on the back wall (43*a*) of the helical groove (41*a*). Specifically, at the point of time when the fluid chamber has entered the state shown in FIG. 6(C), the gate (51*a*) slides on the front wall (42*a*), the back wall (43*a*), and the bottom (44) of the helical groove (41*a*), and the fluid chamber (23*a*) is divided from the low pressure space (S1) by the gate (51*a*). Thus, at the point of time when the fluid chamber has entered the state shown in FIG. 6(C), the fluid chamber (23*a*) is closed, and is divided from the low pressure space (S1) by both of the cylindrical wall (30) and the gate (51*a*). Thus, the suction phase is finished.

In the screw compressor (1) of the present embodiment, the fluid chamber (23*a*) in the suction phase is first divided from the low pressure space (S1) when the helical groove (41*a*) constituting the fluid chamber moves from a position where the helical groove faces the inlet (36) to a position where the helical groove is covered with the cylindrical wall (30), and is then divided from the low pressure space (S1) by the gate (51*a*) which enters the helical groove (41*a*) constituting the fluid chamber. In this screw compressor (1), the shape of the inlet edge (37) of the inner side surface (35) of the cylindrical wall (30) is designed in such a manner that the fluid chamber (23*a*) in the suction phase is divided by the cylindrical wall (30) from the low pressure space (S1) before being divided by the gate (51*a*) from the low pressure space (S1).

In the screw compressor (1) of the present embodiment, alternating current from the commercial power supply (101) is supplied to the electric motor (15) for driving the screw rotor (40) through the inverter (100). When the frequency output by the inverter (100) is changed, rotational speed of the electric motor (15) is changed, and rotational speed of the screw rotor (40) driven by the electric motor (15) is changed. The change in rotational speed of the screw rotor (40) changes a mass flow rate of the refrigerant which is sucked into the screw compressor (1) and discharged after compression. Specifically, the change in rotational speed of the screw rotor (40) changes operating capacity of the screw compressor (1).

A lower limit value of the output frequency of the inverter (100) is set lower (e.g. Hz), and an upper limit value is set higher (e.g., 120 Hz), than a frequency of the alternating current supplied from the commercial power supply (101) (e.g., 60 Hz). Thus, the rotational speed of the screw rotor (40) of the screw compressor (1) of the present embodiment can be changed in the range from the lower value to the higher value as compared with the case where the alternating current from the commercial power supply (101) is directly supplied to the electric motor (15).

Advantages of Embodiment

In the screw compressor (1) of the present embodiment, the fluid chamber (23*a*) in the suction phase is first covered with the cylindrical wall (30), and is then divided from the low pressure space (S1) by the gate (51*a*) which enters the helical groove (41*a*). Specifically, in this screw compressor (1), the fluid chamber (23*a*) in the suction phase is divided from the low pressure space (S1) by the cylindrical wall (30) which covers the helical groove (41*a*) constituting the fluid chamber in a relatively early stage.

With the fluid chamber (23*a*) in the suction phase covered with the cylindrical wall (30), the cylindrical wall (30) prevents the gaseous refrigerant from flowing out of the fluid chamber (23*a*) even when centrifugal force caused by the rotation of the screw rotor (40) is acted on the gaseous refrigerant in the fluid chamber (23*a*). Thus, according to the present embodiment, the amount of the gaseous refrigerant which leaks from the fluid chamber (23*a*) toward the outer peripheral surface of the screw rotor (40) due to the centrifugal force can be reduced, and the amount of the gaseous refrigerant sucked into the fluid chamber (23*a*) in the suction phase can be increased. This can improve efficiency of operation of the screw compressor (1).

In the screw compressor (1) of the present embodiment, the gate (51*a*) enters the helical groove (41*a*) which constitutes the fluid chamber (23*a*) in the suction phase through the start end thereof after the fluid chamber (23*a*) is covered with the cylindrical wall (30). As the gate (51*a*) travels into the helical groove (41*a*) through the start end, the low pressure gaseous refrigerant is pushed by the gate (51) into the fluid chamber (23*a*) formed by the helical groove (41*a*). In this screw compressor (1), the fluid chamber (23*a*) in the suction phase has been divided from the low pressure space (S1) by the cylindrical wall (30) when the gate (51*a*) pushes the low pressure gaseous refrigerant into the fluid chamber (23*a*) in the suction phase. Thus, the low pressure gaseous refrigerant pushed into the fluid chamber (23*a*) by the gate (51*a*) does not leak toward the outer peripheral surface of the screw rotor (40), and remains in the fluid chamber (23*a*). According to the present embodiment, the amount of the low pressure gaseous refrigerant which flows into the fluid chamber (23*a*) in the suction phase can be increased by the gate (51*a*) pushing the low pressure gaseous refrigerant into the fluid chamber (23*a*). This can improve the efficiency of operation of the screw compressor (1).

In the screw compressor (1) of the present embodiment, the inlet edge (37) of the inner side surface (35) of the cylindrical wall (30) is parallel to the front edge (46) of the circumferential sealing face (45). Thus, an opening of the helical groove (41) in the outer peripheral surface of the screw rotor (40) facing the inlet (36) is kept opened to the low pressure space (S1) throughout the whole length thereof from the start end to the terminal end until the front edge (46) of the circumferential sealing face (45) coincides with the inlet edge (37) of the inner side surface (35) of the cylindrical wall (30). Therefore, according to the present embodiment, an area of the opening of the helical groove (41*a*) constituting the fluid chamber (23*a*) in the suction phase and facing the inlet (36) can be kept as large as possible until the front edge (46*a*) of the circumferential sealing face (45*a*) coincides with the inlet edge (37) of the inner side surface (35) of the cylindrical wall. This can reduce pressure loss which is caused when the low pressure gaseous refrigerant flows from the low pressure space (S1) to the fluid chamber (23*a*) in the suction phase.

In the screw compressor (1) of the present embodiment, the inlet wall surface (38) of the cylindrical wall (30) is inclined to face the outer peripheral surface of the screw rotor (40). Thus, the direction of the flow of the low pressure gaseous refrigerant which is hit against the inlet wall surface (38) of the cylindrical wall (30) is smoothly changed toward the axial center of the screw rotor (40) by the inclined inlet wall surface (38). Therefore, according to the present embodiment, turbulent flow of the low pressure gaseous refrigerant to the fluid chamber (23*a*) in the suction phase can be reduced, thereby reducing pressure loss which is caused when the low pressure gaseous refrigerant flows from the low pressure space (S1) to the fluid chamber (23*a*) in the suction phase.

In the screw compressor (1) of the present embodiment, the alternating current from the commercial power supply (101) is supplied to the electric motor (15) for driving the screw rotor (40) through the inverter (100). When the output frequency of the inverter (100) is changed, the rotational speed of the screw rotor (40) is changed, thereby changing the operating capacity of the screw compressor (1).

In the screw compressor (1) whose operating capacity can be changed by changing the output frequency of the inverter (100), the rotational speed of the screw rotor (40) may be set higher as compared with the case where the alternating current from the commercial power supply (101) is directly supplied to the electric motor (15). When the rotational sped of the screw rotor (40) increases, the centrifugal force acted on the gaseous refrigerant in the fluid chamber (23*a*) in the suction phase also increases, and the amount of the gaseous refrigerant leaks from the fluid chamber (23*a*) toward the outer peripheral surface of the screw rotor (40) may increase.

To prevent the leakage in the screw compressor (1) of the present embodiment, the helical groove (41*a*) constituting the fluid chamber (23*a*) in the suction phase is first divided from the low pressure space (S1) by the cylindrical wall (30), and is then divided from the low pressure space (S1) by the gate (51*a*) which enters the helical groove (41*a*). Thus, the fluid chamber (23*a*) in the suction phase can be divided from the low pressure space (S1) by the cylindrical wall (30) covering the helical groove (41*a*) constituting the same fluid chamber in a relatively early stage. Therefore, in the screw compressor (1) of the present embodiment in which the rotational speed of the screw rotor (40) can be set high, the amount of the gaseous refrigerant which leaks from the fluid chamber (23*a*) toward the outer peripheral surface of the screw rotor (40) due to the centrifugal force can be reduced. This can keep the efficiency of operation of the screw compressor (1) high.

Travel speed of the gate (51) increases with the increase in rotational speed of the screw rotor (40). The higher the travel speed of the gate (51) is, the less fluid leaks from the fluid chamber (23*a*) in the suction phase toward the start end of the helical groove (41*a*) while the gate (51) travels into the helical groove (41). Specifically, the higher the rotational speed of the screw rotor (40) is, the more low pressure gaseous refrigerant is pushed into the fluid chamber (23*a*) in the suction phase by the gate (51*a*). Thus, in the screw compressor (1) of the present embodiment, the amount of the low pressure gaseous refrigerant flowing to the fluid chamber (23*a*) in the suction phase can sufficiently be ensured even when the rotational speed of the screw rotor (40) is set high. This can keep the efficiency of operation of the screw compressor (1) high.

Alternative of Embodiment

Figure 9:
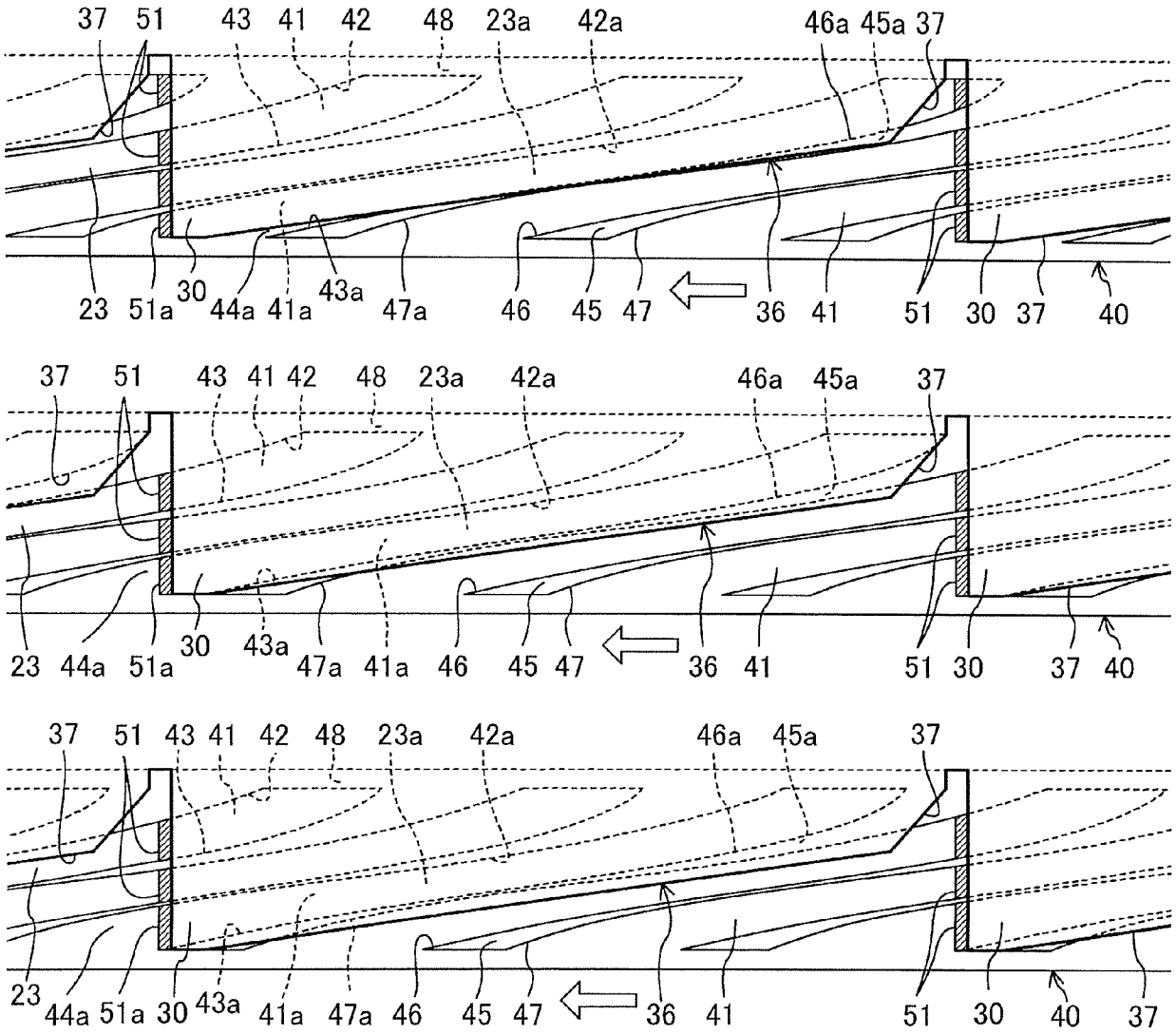
FIGS. 9(A) to 9(C) are development views of a screw rotor and a cylindrical wall according to an alternative of the embodiment.

In the screw compressor (1) of the present embodiment, the shape of the inlet edge (37) of the inner side surface (35) of the cylindrical wall (30) of may be different from that of the front edge (46) of the circumferential sealing face (45)

of the screw rotor (40) as shown in FIGS. 9(A)-9(C) (i.e., the inlet edge is not parallel to the front edge (46) of the circumferential sealing face (45)). In this alternative, as shown in FIG. 9(B), the gate (51*a*) which is about to enter the helical groove (41*a*) slides only on the front wall (42*a*) and the bottom (44*a*) of the helical groove (41*a*), and does not slide on the back wall (43*a*) of the helical groove (41*a*) at the point of time when the helical groove (41*a*) constituting the fluid chamber (23*a*) in the suction phase is fully covered with the cylindrical wall (30). Thus, also in this alternative, the fluid chamber (23*a*) in the suction phase is first divided by the cylindrical wall (30), and is then divided by the gate (51), from the low pressure space (S1).

The above-described embodiment has been set forth merely for the purposes of preferred examples in nature, and is not intended to limit the scope, applications, and use of the invention.

INDUSTRIAL APPLICABILITY

As described above, the present invention is useful for the single screw compressors.

What is claimed is:

1. A single screw compressor comprising:

a screw rotor including a plurality of helical grooves opened in an outer peripheral surface of the screw rotor to form fluid chambers;

a gate rotor including a plurality of radially arranged gates meshing with the helical grooves of the screw rotor; and a casing containing the screw rotor and the gate rotor, each of the gates relatively moving from a start end to a terminal end of one of the helical grooves when the gate meshes with the helical groove and the screw rotor is rotated about a rotation axis in order to compress fluid in the fluid chamber formed by the helical groove, the rotation axis defining an axial direction, the casing having a low pressure space into which uncompressed, low pressure fluid sucked into the casing flows, communicating with the start end of the helical groove opened in an end face of the screw rotor, and a divider wall covering the outer peripheral surface of the screw rotor to divide the fluid chamber formed by the helical groove from the low pressure space, with an inlet formed in the divider wall to partially expose the outer peripheral surface of the screw rotor to the low pressure space, the inlet being formed in the divider wall and disposed radially outward of the outer peripheral surface of the screw rotor relative to the rotation axis such that the low pressure fluid flows from the low pressure space into the inlet and radially inward from the inlet to the outer peripheral surface of the screw rotor partially exposed, and the fluid chamber in a suction phase into which the low pressure fluid flows from the low pressure space being divided from the low pressure space by the gate entering the helical groove after the helical groove has moved from a position where the helical groove communicates with the inlet by covering only part of the helical groove with the divider wall to a position where the helical groove is sealed from communicating with the inlet by the divider wall covering a whole part of the helical groove.

2. The single screw compressor of claim 1, wherein part of the outer peripheral surface of the screw rotor is sandwiched between two adjacent helical grooves to form a circumferential sealing face slidable on an inner side surface of the divider wall to seal between the two adjacent helical grooves, an edge of the circumferential sealing face is positioned forward in a direction of rotation of the screw rotor to form a front edge of the circumferential sealing face, and an inlet edge of the inner side surface of the divider wall facing the inlet is curved to be parallel to the front edge of the circumferential sealing face.

3. The single screw compressor of claim 1, wherein an inlet wall surface of the divider wall facing the inlet is inclined to face the outer peripheral surface of the screw rotor.

4. The single screw compressor of claim 1, further comprising:

an electric motor arranged to rotate the screw rotor; and an inverter arranged and configured to change a frequency of alternating current supplied to the electric motor, a rotational speed of the screw rotor being changeable by changing the frequency output by the inverter.

5. The single screw compressor of claim 2, wherein an inlet wall surface of the divider wall facing the inlet is inclined to face the outer peripheral surface of the screw rotor.

6. The single screw compressor of claim 1, wherein a dimension of the inlet in a circumferential direction of the divider wall is gradually reduced from a low pressure space end of the screw rotor to an opposite axial end of the screw rotor, as viewed in a direction transverse to the axial direction.

7. The single screw compressor of claim 1, wherein part of the outer peripheral surface of the screw rotor is sandwiched between two adjacent helical grooves to form a circumferential sealing face slidable on an inner side surface of the divider wall to seal between the two adjacent helical grooves, an edge of the circumferential sealing face is positioned forward in a direction of rotation of the screw rotor to form a front edge of the circumferential sealing face, and an edge of an inner side surface of the divider wall facing the inlet constitutes an inlet edge.

8. The single screw compressor of claim 7, wherein the inlet edge is parallel to the front edge of the circumferential sealing face throughout a whole length thereof.

* * * * *